United States Patent [19]

Pfarrwaller

[11] Patent Number: 4,883,098

[45] Date of Patent: Nov. 28, 1989

[54] PROJECTILE OPENER AND LIFT FOR A PROJECTILE LOOM

[75] Inventor: Erwin Pfarrwaller, Winterthur, Switzerland

[73] Assignee: Sulzer Brothers Limited, Winterthur, Switzerland

[21] Appl. No.: 262,900

[22] Filed: Oct. 26, 1988

[30] Foreign Application Priority Data

Nov. 20, 1987 [CH] Switzerland ..... 04516/87

[51] Int. Cl.[4] ..... D03D 47/24; D03D 47/27; D03J 5/06

[52] U.S. Cl. ..... 139/439

[58] Field of Search ..... 139/439, 438, 188 R

[56] References Cited

U.S. PATENT DOCUMENTS

| | | | |
|---|---|---|---|
| 2,865,405 | 12/1958 | Pfarrwaller | 139/439 |
| 4,192,356 | 3/1980 | Pfarrwaller | 139/439 |
| 4,488,579 | 12/1984 | Lincke | 139/439 X |
| 4,593,724 | 6/1986 | Pfarrwaller | 139/439 X |

FOREIGN PATENT DOCUMENTS

| | | |
|---|---|---|
| 0185917 | 11/1985 | European Pat. Off. . |
| 2393093 | 5/1978 | France . |
| 2007273 | 5/1979 | United Kingdom . |

*Primary Examiner*—Andrew M. Falik
*Attorney, Agent, or Firm*—Kenyon & Kenyon

[57] ABSTRACT

A picking mechanism for a loom including a projectile lift which points a projectile into a ready-to-pick position is made with a guide profile cross section open on the striking side. The projectile opener is provided with an additional guide element to guide the projectile body during movement into the ready-to-pick position. After positioning, the projectile opener with the guide element pivots away to expose a semi-circular space on the striking side of the projectile for the operation of a picking mechanism. The opener guide element may engage with an outer surface of the projectile during pivoting or may be positioned coaxially of a gripper opener to engage an internal surface in an additional passage in the projectile.

16 Claims, 4 Drawing Sheets

PROJECTILE OPENER AND LIFT FOR A PROJECTILE LOOM

Figure 1:
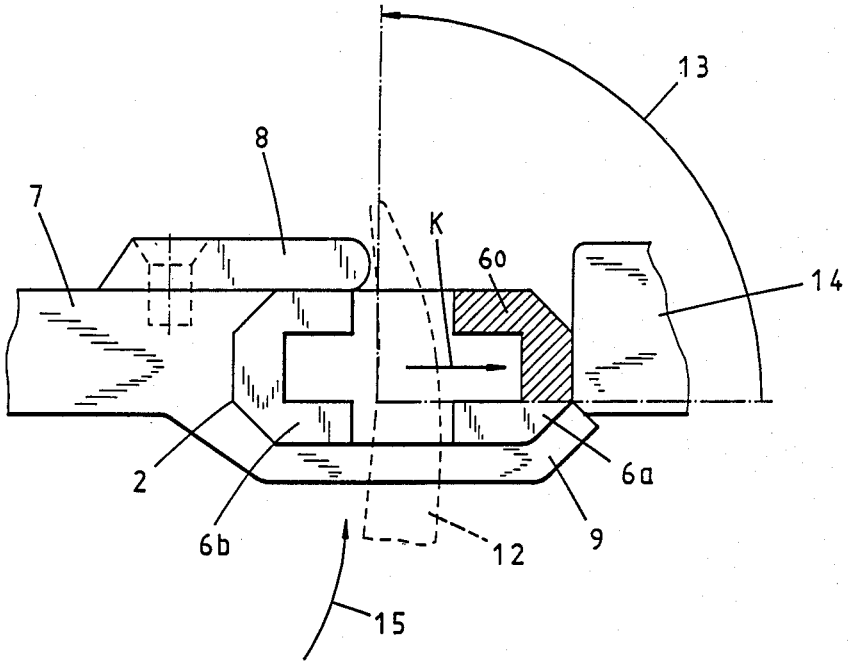
FIG. 1 PRIOR ART

This invention relates to a projectile opener and lift for a projectile loom.

Heretofore, it has been known to provide a projectile loom with a projectile lift as well as a projectile opener for pivoting-up and positioning a projectile into a ready-to-pick position. In conventional projectile looms, a retractor mechanism is used to push a projectile into the projectile lift where the projectile opener opens a gripper within the projectile. Thereafter, the lift and the opener cooperate to pivot the projectile upwardly with the gripper opened into the ready-to-pick position. The projectile opener then pivots away independently while the projectile remains in the lift ready for picking.

In order to ensure that centrifugal forces cannot move the projectile out of the lift during the upward pivoting movement, the lift must have a cross sectional profile sufficient to engage around approximately seventy five percent of the projectile periphery. Consequently, only about twenty five percent of the periphery, i.e. effectively, a quadrant shaped space, remains open for picking, that is, for the movements of a picking mechanism. U.S. Pat. No. 4,262,394 and corresponding German Pat. No. 2757287 describe various constructions of a projectile lift of this type wherein consideration is given to the supply and transfer of a weft yarn to the projectile gripper.

The quadrant-shaped space remaining for the picking mechanism has been found to be inadequate for increasing loom performances and increasing picking rates. That is, increased performance requires a considerable increase in the space available for picking.

Accordingly, it is an object of the invention to provide for a greater amount of available space for a picking : mechanism in a projectile lifter.

It is another object of the invention to increase the performance of a picking mechanism.

It is another object of the invention to provide a simplified projectile opener and lifter arrangement for increased performance of a loom.

Briefly, the invention provides a loom with a projectile lift for pivoting and positioning a projectile into a ready-to-pick position which has a guide profile cross section opened on a striking side. In addition, a projectile opener which is pivotal with the lift is also provided with a guide element for engaging a guide surface of the projectile during pivoting of the projectile into the ready-to-pick position. After positioning of the projectile, the opener is independently movable away from the ready-to-pick position to permit a picking mechanism to operate on the positioned projectile.

The guide profile of the projectile lift is such as to leave a semi-circular space open on the striking side to receive one-half of a rear boundary surface of the projectile.

The guide element provided on the opener may be in the form of a finger and is positioned to engage an outer surface of the projectile or the finger may be positioned to engage an internal guide surface of the projectile.

Preferably, the guide profile cross section of the projectile lift is opened through at least 180°. Consequently, during the upwardly pivoting movement, both the guide profile of the lift and the guide element of the projectile opener retain and move the projectile reliably into the ready-to-pick position without centrifugal forces turning the projectile out of the prescribed path. Accordingly, the guide function of the projectile lift is taken over to some extent by the guide element of the opener but without impairment of the opener function of the opener.

Since the guide element pivots with the opener away from the ready-to-pick position after positioning of the projectile, the entire open semi-circular space of the lift cross section is exposed for a subsequent picking, that is, made available for the movements of a picking mechanism. As a result, there is a considerable improvement in the performance of the picking mechanism as well as in a higher picking rate.

The projectile lift and projectile opener construction permits the entire rear boundary surface of the projectile body to be used alternately as a picking surface. That is, at each pick, one half of the boundary surface is disposed in the free semi-circular space of the lift and the projectile is turned through 180° after each pick. Thus, the two half surfaces of the projectile can be used in an alternating fashion. As a result, the specific pressure loading and therefor the wear of the rear projectile surfaces can be considerably reduced. This also boosts picking performance.

Where the guide element is to engage an internal surface of the projectile, the guide element and a finger on the opener for opening a gripper are coaxially disposed is formed with a passage which is symmetrical of the axis of the projectile in order to receive the guide element. In this embodiment, the guide element takes up less space.

In the embodiment where the guide element abuts an outside surface of the projectile, the projectile does not require a passage which would otherwise reduce the braking area.

In order to provide satisfactory leverage with respect to the centrifugal forces during the upward pivoting of the projectile, the support lever length from the mounting position at the rear end of the projectile body as far as the guide element is made at least half the load lever length from the mounting position to the center of gravity of the projectile where the centrifugal forces are operative.

Figure 2A:
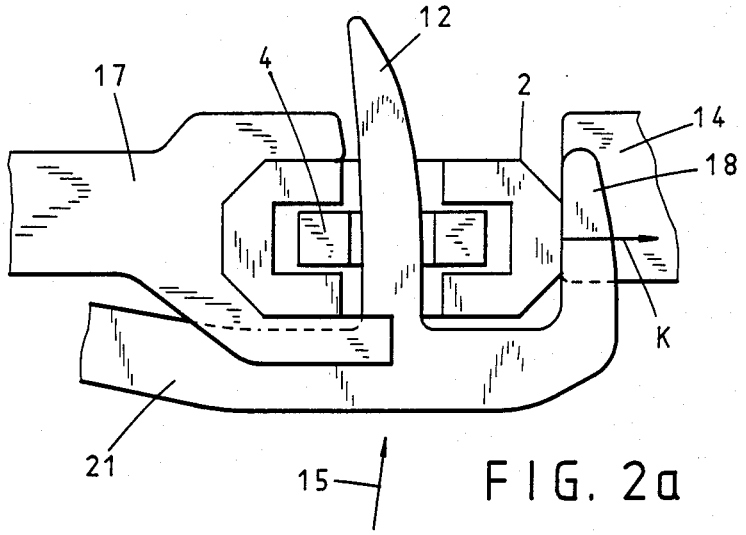
Figure 2B:
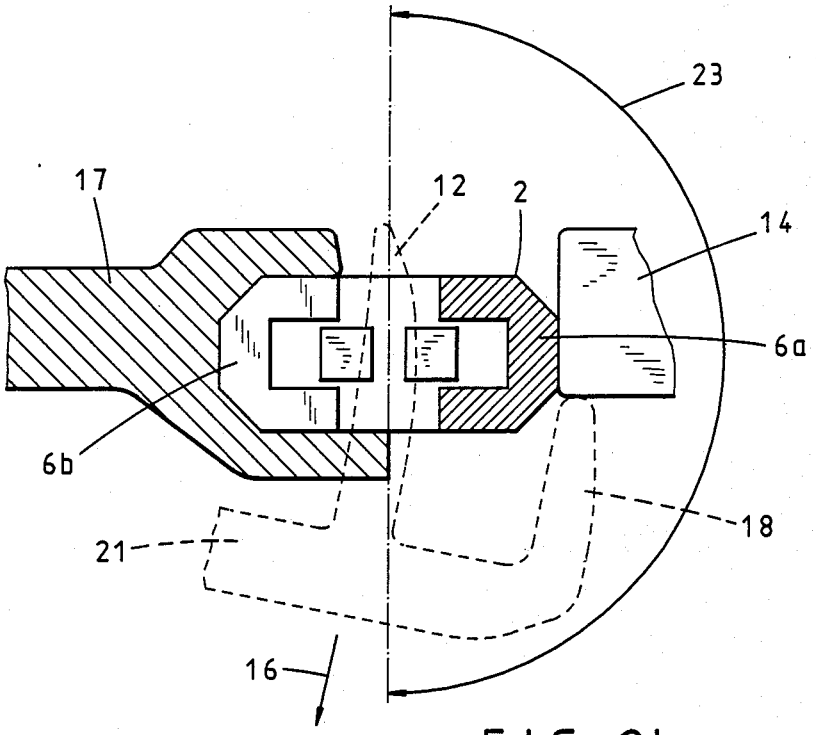
Figure 3A:
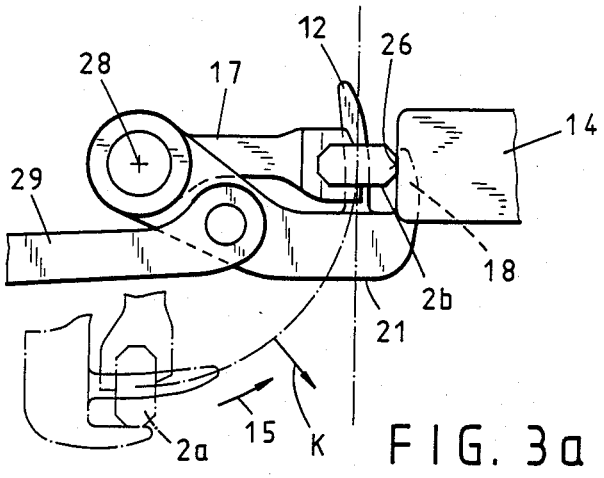
Figure 3B:
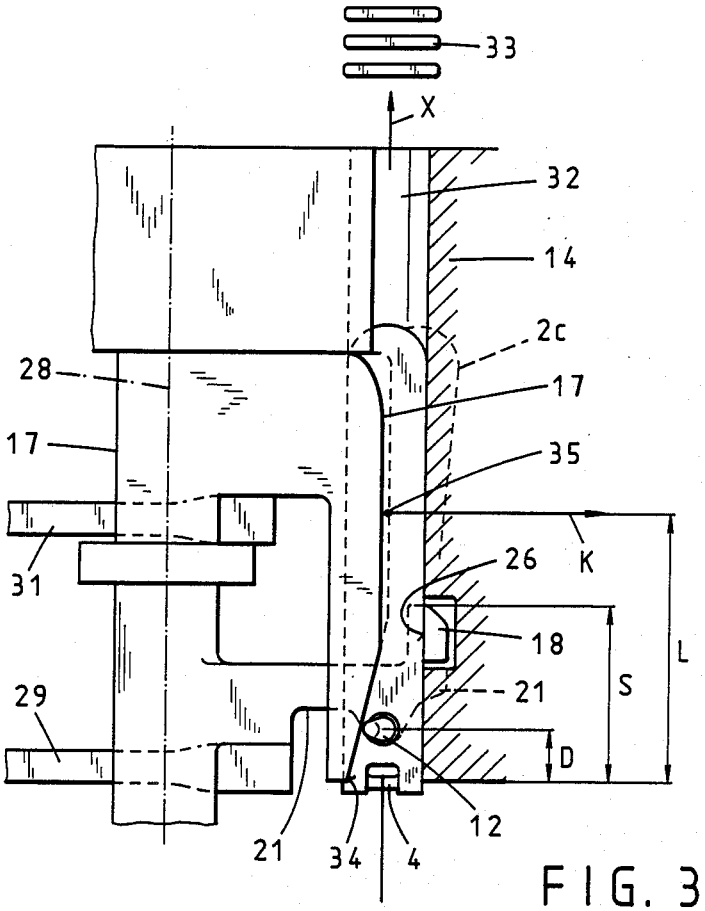
Figure 4A:
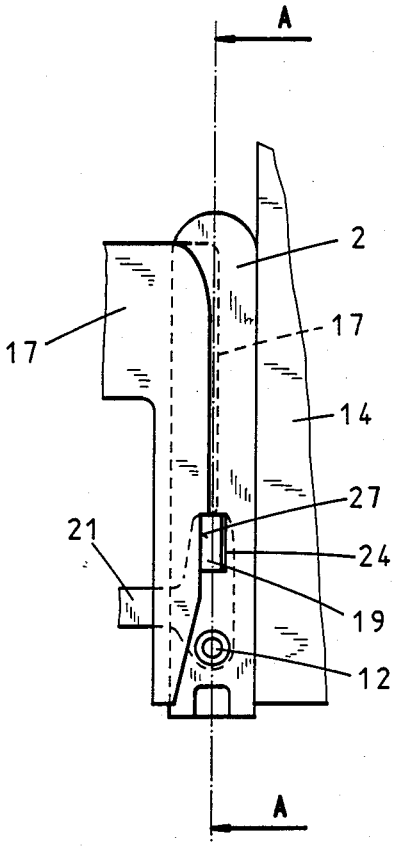
Figure 4B:
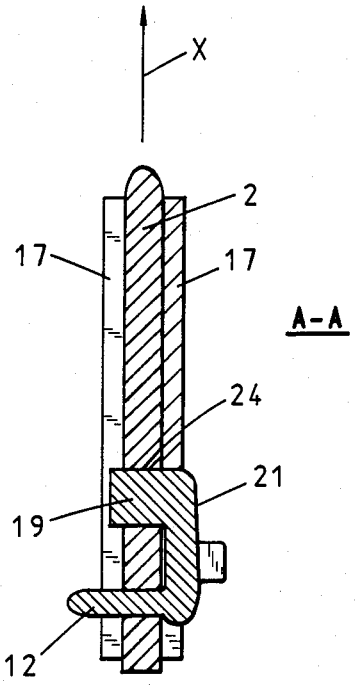

These and other objects and advantages of the invention will become more apparent from the following detailed description taken in conjunction with the accompanying drawings wherein:

FIG. 1 illustrates a part cross sectional view of a conventional projectile lift;

FIG. 2*a* illustrates an end view of a projectile lift and projectile opener constructed in accordance with the invention;

FIG. 2*b* illustrates a cross sectional view of the projectile lift of FIG. 2*a* with a semi circular open space for a picking mechanism;

FIG. 3*a* illustrates a projectile lift and projectile opener coupled with a means for pivoting the opener independently of the lift in accordance with the invention;

FIG. 3*b* illustrates a plan view of the ready-to-pick position of a projectile in a loom constructed in accordance with the invention;

FIG. 4*a* illustrates a modified projectile opener in a ready-to-pick position of a projectile; and FIG. 4*b* illustrates a view taken on line A—A of FIG. 4*a*.

Referring to FIG. 1, in a known construction, a projectile 2 is moved through an arcuate path 15 into a ready-to-pick position by means of a projectile lift 7. In order to ensure reliable guiding of the projectile during an upwardly pivoting movement, the lift 7 has a guide profile which engages around approximately 75% of the periphery of the projectile. For this purpose, a cover 8 is secured to the lift to overlie a half-surface **6*b* of the forward surface of the projectile, while an extended projection 9 of the lift 7 engages about a halfsurface 6*b*** a of the rear boundary surface of the projectile.

As is known, a projectile opener, for example, having a finger 12, moves with the lift 7 and serves to open a gripper (not shown) within the projectile 2. After the finger 12 pivots back in an opposite direction away from the projectile 2, a quadrant-shaped space 13 in the guide profile cross indicated, a lateral guide bar 14 which forms a part of a picking tunnel for the projectile 2 is also disposed within this space 13. Likewise, only a fractional part 60 of the half-surface **6*a* of the rear boundary surface of the projectile body is disposed in the space 13**. Such restricted space conditions have severely limited conventional picking mechanisms.

Referring to FIGS. **2*a* and 2*b*, a projectile lift 17 having a guide profile cross section which is open on the striking side is used for pivoting a projectile into a ready-to-pick position. However, the guide profile extends only around approximately 50% of the periphery of the projectile 2 on the lift side and leaves open a complete semi-circular space 23 (see FIG. 2*b***) on the striking side.

A projectile opener 21 cooperates with the lift 17 and has a finger 12, as above, for opening a gripper 4 within the projectile 2 as well as an outer guide element in the form of a tongue or finger 18 to ensure reliable guidance of the projectile 2 during the upward pivoting movement. As indicated, the guide element 18 engages an outside guide surface of the projectile 2 during pivoting of the projectile into the ready-to-pick position adjacent the lateral guide bar 14 of the picking tunnel. As such, the guide element 18 supports the projectile 2 against centrifugal force K.

As indicated in FIG. **2*b*, after the upward pivoting of the projectile 2 into the ready-to-pick position, the opener 21 with the finger 12 and guide element 18 pivots downwardly in ' the direction indicated by the arrow 16. The semi-circular space 23 is thus made available for picking, that is, for the movements of a picking mechanism. As also indicated, a complete half-surface 6*a* of the rear boundary surface of the projectile is exposed within the semi-circular space 23 while the rear boundary surface 6*b* remains within the projectile lift 17. At the next pick, the projectile 2 will be turned through 180° so that the other half-surface 6*b* comes into the open semi-circular space 23. The two complete half-surfaces 6*a*, 6*b*** can therefore be used for increased picking performance.

Referring to FIGS. **3*a* and 3*b*, wherein like reference characters indicate like parts as above, the guide element 18 on the projectile opener 21 is integral therewith. In addition, the loom has a means for pivoting the lift 17 and the opener 21 simultaneously to position the projectile in the ready-to-pick position as well as a means for pivoting the opener 21 away from the ready-to-pick position independently of the lift 17. To this end, the first means is constituted by an opener rod 29 and lift rod 31 (see FIG. 3*b*) each of which is pivotally connected to the respective opener 21 and lift 17 to rotate each about a common axis of rotation 28 from a lower position 2*a* of the projectile (see FIG. 3*a*) to the ready-to-pick position 2*b*. During this time, the guide element 18 supports the projectile 2** against centrifugal force K.

As indicated in FIG. **3*b*, the opener 21 and lift 17 are independently mounted about the axis of rotation 28 and are separated by a suitable collar or the like. Further, a separate means is connected to the opener rod 29 to pivot the opener 21 independently of the lift 17** away from the ready-to pick position.

As indicated in FIG. **3*b*, a support lever length S extends, as considered in the picking direction X, from a mounting position 34 at the rear end (i.e. striking side) of the projectile 2 or lift profile as far as the front end of the guide element 18. A load lever length L extends from the position 34 as far as the center of gravity 35 of the projectile 2. Preferably, the support lever length S is at least half the load lever length L. In theory, a minor support effect can be provided over a lever length D between the position 34 and the opener finger 12. However, not only is the distance D much too short but also, the bearing by way of the finger 12 on the resilient projectile gripper 4 is still resilient. Therefore, without the guide element 18, the support effect provided by the lever length D could not prevent centrifugal force K from turning the projectile into a skewed position 2*c*, as shown in dotted line in FIG. 3*b*. In this case, the projectile would jam below the guide bar 14 and the loom would become jammed and damaged. With the described construction, the semi-circular space left open by the lifter 17 is available for picking the projectile 2 towards the picking tunnel 32 and guide teeth 33**.

Referring to FIGS. **4*a* and 4*b*, wherein like reference characters indicate like parts as above, if the space requirement of the guide element which pivots in the zone of the lateral guide bar 14 needs to be reduced, a guide element 19 may be disposed on the opener 21 coaxially of the opener finger 12, that is, longitudinally of the projectile 2. In addition, the projectile 2 is provided with an internal passage 24 which is symmetrical of the picking direction X as well as the longitudinal axis of the projectile to receive the guide element 19. This passage 24 includes an inner guide surface 27 for the guide element 19**.

The invention thus provides a projectile lift and opener of relatively simple construction for retaining a projectile against centrifugal force when moving the projectile to a ready-to-pick position as well as providing a relatively large space for the operations of a picking mechanism in the ready-to-pick position.

The invention also allows greater performance of a loom to be achieved by exposing a greater space for the operations of a picking mechanism on a ready-to-pick projectile.

What is claimed is:

1. In a projectile loom, the combination comprising a projectile lift for pivoting and positioning a projectile into a ready-to-pick position, said lift having a guide profile cross-section open on a striking side of the projectile; and a projectile opener pivotal with said lift to open a gripper in the projectile said opener including a guide element for engaging a guide surface of the projectile during pivoting of the projectile into said ready-to-pick position.

2. The combination as set forth in claim 1 wherein said guide profile leave a semi-circular space open on said striking side to receive one half of a rear boundary surface of the projectile.

3. The combination as set forth in claim 1 wherein said guide element is a finger.

4. The combination as set forth in claim 3 wherein said guide surface is an outside surface of the projectile.

5. The combination as set forth in claim 3 wherein said guide surface is an internal surface of the projectile.

6. The combination as set forth in claim 1 wherein said guide element defines a support lever length equal to at least half a load lever length to the center of gravity of the projectile.

7. A picking mechanism comprising the combination of a pivotally mounted projectile lift for pivoting a projectile into a ready-to-pick position, said lift having an open side to receive the projectile therein; and a pivotally mounted projectile opener having both a finger to open a gripper in the projectile and a guide element for engaging a guide surface of the projectile during pivoting with said lift to position the projectile in said ready-to-pick position and to retain the projectile in said lift against centrifugal force during pivoting of said opener with said lift.

8. The combination as set forth in claim 7 wherein said guide element is disposed opposite said lift and said guide surface is an exterior surface of the projectile.

9. The combination as set forth in claim 7 wherein said guide element is disposed opposite to said lift and said guide surface is an interior surface of the projectile.

10. The combination as set forth in claim 7 which further comprises means for pivoting said lift and said opener simultaneously to position a projectile in said ready-to-pick position.

11. The combination as set forth in claim 10 which further comprises means for pivoting said opener away from said ready-to-pick position independently of said lift.

12. The combination as set forth in claim 7 wherein aid finger and said guide element are coaxially disposed longitudinally of a projectile.

13. In a loom, the combination comprising a picking tunnel for a projectile having a lateral guide wall;

a projectile lift for pivoting a projectile into a ready-to-pick position in said tunnel and against said guide wall, said lift having a guide profile for the projectile of a cross-section open towards said guide wall; and a projectile opener having both a finger for opening a gripper in the projectile and a guide element for engaging a guide surface of the projectile during pivoting with said lift to position the projectile in said ready-to-pick position and to retain the projectile in said lift against centrifugal force during pivoting of said opener with said lift.

14. The combination as set forth in claim 13 wherein said finger and said guide element are coaxially disposed longitudinally of a projectile.

15. The combination as set forth in claim 13 which further comprises means for pivoting said opener away from said ready-to-pick position independently of said lift.

16. The combination as set forth in claim 13 wherein said guide element defines a support lever with a rear point of said lifter for the projectile equal to at least one-half of a load lever extending from said point of said lifter to the center of gravity of the projectile.

* * * * *

UNITED STATES PATENT AND TRADEMARK OFFICE

CERTIFICATE OF CORRECTION

PATENT NO. : 4,883,098

DATED : Nov. 28, 1989

INVENTOR(S) : ERWIN PFARRWALLER

It is certified that error appears in the above-identified patent and that said Letters Patent is hereby corrected as shown below:

Column 1, line 38 delete ":"
Column 1, line 61 "surface" should be -guide surface-
Column 2, lines 27, 28 "disposed is" should be -disposed longitudinally of the projectile. In addition, the projectile is-
Column 3, line 9 "6b a" should be -6a-
Column 3, line 15 "cross indicated" should be -cross section of the lift 7 remain open for picking purposes. As indicated-
Column 4, line 61 "projectile said" should be -projectile, said-
Column 4, line 66 "leave" should be -leaves-
Column 6, line 4 "aid" should be -said- Signed and Sealed this Twenty-ninth Day of January, 1991

*Attest:*

*Attesting Officer*

HARRY F. MANBECK, JR.

*Commissioner of Patents and Trademarks*